United States Patent [19]

Erickson

[11] Patent Number: 4,781,739

[45] Date of Patent: Nov. 1, 1988

[54] LOW ENERGY HIGH PURITY OXYGEN INCREASED DELIVERY PRESSURE

[76] Inventor: Donald C. Erickson, 1704 S. Harbor La., Annapolis, Md. 21401

[21] Appl. No.: 19,042

[22] Filed: Feb. 26, 1987

Related U.S. Application Data

[63] Continuation-in-part of Ser. No. 642,103, Aug. 20, 1984, Pat. No. 4,578,095.

[51] Int. Cl.[4] ..... F25J 3/04

[52] U.S. Cl. ..... 62/22; 62/25; 62/31; 62/34; 62/38

[58] Field of Search ..... 62/9, 11, 22–28, 62/31, 32, 34, 36, 38, 39, 41, 42

[56] References Cited

U.S. PATENT DOCUMENTS

| | | | |
|---|---|---|---|
| 3,688,513 | 9/1972 | Streich | 62/22 |
| 3,751,933 | 8/1973 | Balabaev et al. | 62/41 X |
| 4,433,989 | 2/1984 | Erickson | 62/22 |
| 4,464,191 | 8/1984 | Erickson | 62/31 |
| 4,578,095 | 3/1986 | Erickson | 62/42 X |

FOREIGN PATENT DOCUMENTS

| | | |
|---|---|---|
| 2854508 | 6/1980 | Fed. Rep. of Germany . |
| 845542 | 7/1984 | South Africa . |
| 756150 | 8/1980 | U.S.S.R. . |

OTHER PUBLICATIONS

Streich, et al., "Production of Large Quantities of Oxygen by an Improved Two Column Process", XIV Int'l Congress of Refrigeration, 09–1975, pp. 513–519.

*Primary Examiner*—Steven E. Warner

[57] ABSTRACT

The low energy triple distillation pressure process for producing high purity industrial oxygen is improved in several ways, including higher $O_2$ pressure, higher recovery of both oxygen and crude argon, and lower $N_2$ content in the argon. This is done with the traditional triple pressure column arrangement (columns 22, 24, and 27 of FIG. 1) preferably by totally condensing liquid air in reboiler 21 and then splitting it with valves 42 and 43; by providing all $LN_2$ reflux duty from reboiler 26; by evaporating product oxygen in 23 with partially condensing air; and by intermediate refluxing column 27 with condenser 28 which provides a separate vapor stream to column 22.

18 Claims, 3 Drawing Sheets

LOW ENERGY HIGH PURITY OXYGEN INCREASED DELIVERY PRESSURE

This application is a continuation-in-part Ser. No. 642,103, filed 8-20-84 now U.S. Pat. No. 4,578,095 granted to Donald C. Erickson on Mar. 25, 1986, for which the PCT application PCT/US85/01596 was published on Feb. 27, 1986 (WO 86/01283).

DESCRIPTION

1. Technical Field

This invention relates to processes and apparatus for fractional distillation of air into large quantities of high purity (at least about 98% purity) oxygen and optional coproduct crude argon, at a high recovery level and low energy requirement. The invention makes possible higher $O_2$ delivery pressures and reduced capital expenditure while achieving the above objectives.

2. Background Art

In conventional dual pressure air distillation processes for the production of high purity oxygen, the HP rectifier overhead vapor reboils the $N_2$ removal column (LP column) bottoms by latent heat exchange. At least about 60% of the supply air, and at times as much as 90% of the supply air, is supplied to the HP rectifier to ensure there is enough $LN_2$ to reflux both columns and achieve high $O_2$ recovery. The conventional process is described quantitatively in FIG. 1 of the technical article "Production of Large Quantities of Oxygen by an Improved Two-Column Process", by M. Streich and J. Dworschak, Paper A3.18 of the XIV International Congress of Refrigeration, September 1975, Moscow, sponsored by the International Institute of Refrigeration. The LP column is comprised of an argon stripping section, a nitrogen stripping section, a nitrogen rectification section, and an argon rectification sidearm which connects to the main column at the junction of the two stripping sections.

Several attempts have been made to lower the energy requirement for distillative production of high purity oxygen. The common features in the successful attempts have been (1) to conduct argon rectification in a separate column operating at lower pressure than the $N_2$ removal column; (2) to reboil the $N_2$ removal column by exchanging latent heat with partially condensing air vice HP rectifier $N_2$, thus making possible lower air supply pressures; and (3) to incorporate an argon stripping section at the bottom of both the $N_2$ removal column and the argon distillation column, i.e., to feed the argon column with a sidestream from the $N_2$ removal column rather than its bottom product.

Notwithstanding these very substantial improvements in high purity oxygen production, several problems still remain, as described below.

Streich et al., (U.S. Pat. No. 3,688,513) discloses a triple pressure, high purity $O_2$, air distillation apparatus and process incorporating the three above features, and further characterized by:

(a) $N_2$ removal column reboiled by partial condensation of the air supply to the HP rectifier;
(b) no liquid argon recovery; crude liquid argon recycled by pump back to the $N_2$ removal column;
(c) HP rectifier overhead $N_2$ provides reboil by latent heat exchange to both the argon column bottoms and an intermediate height of the $N_2$ removal column;

(d) product oxygen is evaporated by latent heat exchange with HP rectifier overhead $N_2$; and
(e) process refrigeration is by conventional methods (air or $N_2$ expansion).

This disclosure has the problems that no argon is recovered and that the $O_2$ production is undesirably low. In locales where argon has value, its value alone will approximate the value of the reduced energy consumption, thereby negating any overall advantage. Where there is no market for crude argon, the low $O_2$ production pressure will require substantial added capital investment in a product $O_2$ compressor. Also, as shown by FIG. 2 of the Streich and Dworschak article cited above, the $O_2$ recovery will be lower than with a conventional process (94% vice 98%). This also increases the capital cost.

Tomisaka (U.S. Pat. No. 4,507,134) discloses a triple pressure high purity $O_2$, air distillation apparatus and process incorporating the three above features, and further characterized by:

(a) supplying approximately half of the supply air directly to the HP rectifier;
(b) supplying most of the remainder to a two step sequential process:
  (i) reboiling the $N_2$ removal column by partial condensation; and then
  (ii) evaporating product oxygen by total condensation of the remainder;
(c) supplying the oxygen-enriched liquid air from step (b)(i) to the HP rectifier, and the oxygen-depleted liquid air from step (b)(ii) to the $N_2$ removal column, both as intermediate reflux;
(d) crude argon is withdrawn from the argon column overhead by a vacuum compressor;
(e) as with Streich et al. the $LN_2$ for refluxing the HP rectifier and the $N_2$ removal column is obtained from two latent heat exchangers, one being an intermediate reboiler for the $N_2$ removal column;
(f) conventional air expansion refrigeration; and
(g) liquid $O_2$ is pressurized for evaporation by a barometric leg.

This disclosure provides the advantages over Streich et al., that at least some crude argon is recovered and that the $O_2$ delivery pressure is increased above that possible with HP rectifier $N_2$ latent heat exchange. However, it has the disadvantages that (1) a higher air supply pressure is necessary, because only less than half of the total supply air is subjected to partial condensation; (2) the increase in $O_2$ delivery pressure is quite small, since LOX is evaporated by total condensation (vice partial) of oxygen depleted air; (3) it is not possible to achieve both high $O_2$ recovery and high argon recovery (partly because of excessive levels of intermediate reflux, plus insufficient intermediate reboil); (4) the conventional refrigeration diverts an undesirably large proportion of the supply air around both the HP rectifier and the argon stripper; and (5) the HP overhead to $N_2$ removal column intermediate height latent heat exchanger also bypasses reboil around both argon strippers, making high $O_2$ purity more difficult to achieve; and it also reduces reboil in the bottom section of the $N_2$ stripping section, making it very difficult to achieve low levels of $N_2$ in the crude argon. This problem is also experienced with Streich et al.

Parent U.S. Pat. No. 4,578,095 discloses a triple pressure air distillation apparatus and process for producing high purity $O_2$ and optional coproduct argon which also incorporates the three generic features described above, and is further characterized by:

(a) means for crude argon withdrawal (as either vapor or liquid or both);

(b) means for intermediate refluxing of the argon distillation column, including associated means for providing intermediate height vapor to the $N_2$ removal column (either feed or reboil). This provision is key to obtaining high yields of both $O_2$ and argon, since it allows greatly increased reboil rates up the bottom part of the argon distillation column.

Additional optional features disclosed in the U.S. Pat. No. 4,578,095 include:

(1) $N_2$ removal column bottoms reboil via partial condensation of the air supply to the HP rectifier, similar to Streich et al.;

(2) conventional refrigeration, either $N_2$ or air expansion;

(3) LOX evaporated by HP rectifier $N_2$; and (4) by elimination of a separate latent heat exchanger between HP rectifier overhead and $N_2$ removal column intermediate height, i.e., by designing the latent heat exchanger between HP rectifier overhead and the argon column bottoms for the entire $LN_2$ duty, the following advantages were obtained:

(i) the $N_2$ stripping section reduces $N_2$ levels in the crude argon to lower levels with fewer $N_2$ stripping stages, due to increased reboil through the critical lower section of the $N_2$ stripper;

(ii) increased argon stripper reboil makes $O_2$ purity easier to achieve with fewer trays; and (iii) one less heat exchanger causes a significant reduction in overall capital cost.

It is this latter inventive feature (4) which is one key aspect of this continuing application. Whereas the U.S. Pat. No. 4,578,095 patent makes possible substantially higher recovery levels of crude argon and high purity oxygen, and lower $N_2$ levels in the crude argon, it does retain two disadvantages: (1) the $O_2$ production pressure is undesirably low, adding capital cost to the $O_2$ compressor; and (2) the argon column overhead is undesirably close to argon freezeup conditions. Also, when kettle liquid is used to provide intermediate reflux to the argon column, it doesn't have as high as $O_2$ content as would be desirable.

Desirable improvements to low energy high purity $O_2$ triple pressure distillation processes include higher $O_2$ recoveries, higher $O_2$ delivery pressures, higher recovery and purity of crude argon, lower supply air pressures, greater margin against argon freezeup, and minimal increase in or preferably an actual decrease in capital cost.

The combination of features necessary to accomplish these objectives are known to some extent individually in the prior art, but never in the context of a low energy triple pressure process for producing high purity oxygen, and also never in the particular combinations disclosed herein as necessary to achieve the desired improvements.

It is known to reboil the bottom of a nitrogen removal column by total condensation of a minor fraction of the feed air: U.S. Pat. Nos. 3,210,951, 4,208,199, 4,410,343, and 4,448,595.

It is known to split a supply of liquid air into two intermediate reflux streams, one for the HP rectifier and one for the $N_2$ removal column: U.S. Pat. Nos. 3,210,951, 4,410,343, and 4,448,595. U.S. Pat. No. 3,798,917 shows a three-way split of liquid air.

It is known to evaporate product oxygen by exchanging latent heat with the air supply of the HP rectifier, which is partially condensed thereby: U.S. Pat. Nos. 3,113,854, 3,371,496, 3,327,489, and 4,560,398.

In many flowsheets, for example, when the LP column is reboiled by HP rectifier $N_2$, and LOXBOIL is via air condensation, the LOXBOIL pressure is somewhat higher than the LP column bottom pressure. Although that pressure increase could be accomplished by a liquid oxygen pump, a preferred method is to use the barometric or hydrostatic head of a column of liquid oxygen, i.e., the boil the LOX at a suitably lower elevation than the LP column bottoms reboiler. This is disclosed in U.S. Pat. Nos. 4,133,662, 4,507,134, 4,560,134, 4,560,398, and South African application 845542 dated July 18, 1984 filed by Izumichi and Ohyama.

It is known to apply the work developed by the refrigeration expander toward additional warm-end compression of part of the compressed air supply. The incremental compression obtained thereby is very economical, since the drive power is "free" and the capital cost of the compander is little different from the capital cost of an expander with some other means of absorbing the power developed. The further compressed air may then be used for conventional refrigeration (German patent application No. 28 54 508 published 06/19/80 and filed by Rohde), or for TC LOXBOIL (U.S. Pat. No. 4,133,662, USSR Pat. No. 756150, and South African application No. 845542 (supra)).

When liquid air intermediate reflux is applied to the LP distillation column, the initial amount added allows a virtually one-for-one reduction in the air supplied to the HP rectifier (for a specified recovery and purity). The benefit from intermediate reflux continues to increase as more is added until a "pinch" is reached: the operating line closely approaches the equilibrium line. Further additions of intermediate reflux beyond that point decrease the benefit, i.e., provide no more decrease in the amount of air which must be supplied to the HP rectifier in order to yield the overhead reflux required. The same benefit is obtained from intermediate refluxing the HP rectifier. For an air separation process wherein liquid air is used as intermediate reflux, the optimal amount of liquid air reflux is about 5 to 10% of the feed air, for both the LP column and the HP rectifier. Greater liquid air flow rates do not provide any further decrease in the overhead ($LN_2$) reflux requirement.

Several prior art disclosures require that the air be supplied to the cold box at two different pressures. One example is the group of companded refrigeration patents described above. Further examples include processes in which the higher pressure air is used to evaporate liquid oxygen (U.S. Pat. Nos. 3,754,406, 4,133,662, and 4,372,764); processes wherein the higher pressure air supplies a second higher pressure rectifier (U.S. Pat. Nos. 4,356,013 and 4,604,116); and also a nitrogen production process wherein the higher pressure fraction reboils the lower pressure column by total condensation (U.S. Pat. No. 4,448,595).

The conventional cryogenic air separation flowsheets provide the bulk of the refrigeration necessary for the overall separation process in either of two conventional manners: by work expanding either part of the HP rectifier overhead nitrogen to exhaust pressure (slightly below LP column overhead pressure), or expanding part of the feed air to LP column intermediate height pressure. U.S. Pat. No. 3,327,488 illustrates the above two approaches in the same flowsheet, although for economic reasons usually only one or the other is used.

The refrigeration compensates for heat leaks, heat exchanger inefficiency, and other effects. Even with the most modern and efficient expanders, there is still required an expander flow of between about 8 and 15% of the inlet air flow to provide the necessary refrigeration, dependent on the size and design of the separation plant.

That large a refrigeration gas flow is highly counterproductive to the objectives enumerated above for several reasons: the flow bypasses the argon stripper, making $O_2$ purity more difficult; it is not available to the argon rectifier, reducing argon recovery; and it is not available for reflux $LN_2$ production reducing $O_2$ recovery.

Although not the essence of this claimed invention, this disclosure does include a description of three refrigeration techniques which each avoid at least part of the problems of conventional refrigeration. One is to warm-compand the refrigeration flow, thereby decreasing the amount, as described above. A second is to partially expand the HP rectifier supply air. This requires a somewhat higher air supply pressure (about 5 to 12 psi higher), but substantially increases the recoveries of both oxygen and argon. Third is to evaporate liquid nitrogen at an intermediate pressure preferably by latent heat exchange with argon column intermediate height liquid, and then work-expand it to exhaust pressure. U.S. Pat. Nos. 2,812,645, 3,905,201, and 4,303,428 illustrate variations of the second technique.

Other prior art triple pressure disclosures pertinent to this invention include U.S. Pat. Nos. 4,533,375 and 4,605,427.

DISCLOSURE OF INVENTION

It has now been discovered that in order to achieve the objectives and avoid the problems enumerated above, there should be three additional features incorporated in the traditional low energy flowsheet. The first, a combination of intermediate reflux to the argon column plus associated intermediate increase in reboil in the $N_2$ removal column, was disclosed and claimed in U.S. Pat. No. 4,605,427. The second, which was disclosed but not claimed in that patent, is to accomplish all $LN_2$ reflux duty in a single heat exchanger which reboils the argon column bottoms, thereby eliminating the HP-overhead-to-$N_2$-removal-column-intermediate-height latent heat exchanger. The third, newly disclosed here, is to reboil the $N_2$ removal column bottoms by total condensation of a limited amount of the supply air, no more than about 25% and preferably about 20%, and then split the resulting liquid air stream into two intermediate reflux streams, one for the HP rectifier and one for the $N_2$ removal column.

Only when all three of the above disclosed improvements are incorporated is it possible to get all of the following improvements: LOXBOIL at relatively high pressure (about 1.6 ATA) via partial condensation of the HP rectifier supply air; full $O_2$ recovery and purity; high argon recovery at approximately 95% purity and with less than about 1% $N_2$ content; comfortable margin to argon freezeup (on the order of 3K); only five separate latent heat exchangers and one expander (or compander); and no requirement for liquid pumps or difficult column relative height displacements.

It is emphasized, however, that each of the three features described above taken alone makes a positive contribution of improvement over the prior art disclosures of low energy triple pressure flowsheets for high purity oxygen. In various circumstances encountered in the practice of the air separation art, not all of the advantageous features described above will necessarily have value. For example, in some cases crude argon is vented vice collected, and in that event measures to increase crude argon recovery or decrease $N_2$ content would not have value, relative to alternative measures which could possible further reduce energy consumption. Thus each of the three features described above individually has merit, not only in conjunction with the other two, but in other environments as well.

More formally, in one aspect the invention comprises:

1. A process for fractional distillation of a supply of cleaned and compressed air to oxygen product of at least 98% purity plus optional coproduct crude argon comprising:

(a) evaporating product oxygen by exchanging latent heat with a major fraction of said supply air, which is partially condensed thereby;

(b) rectifying the uncondensed remainder of said major fraction to overhead $N_2$ and kettle liquid bottoms in a high pressure (HP) rectifier;

(c) totally condensing a minor fraction of the supply air in a reboiler for a nitrogen removal column, thereby providing bottoms reboil to said column (d) splitting the liquid air into two streams and feeding one each of said HP rectifier and said $N_2$ removal column as respective intermediate refluxes therefor;

(e) feeding the kettle liquid in fluid phase to said $N_2$ removal column;

(f) withdrawing a sidestream liquid oxygen-argon mixture substantially free of nitrogen from an intermediate height of said $N_2$ removal column below the feed height;

(g) distilling said liquid sidestream in an argon distillation column to crude argon overhead product and liquid oxygen bottom product;

(h) withdrawing liquid oxygen bottom product from both the $N_2$ removal column and the argon distillation column;

(i) increasing the liquid oxygen pressure to the evaporation pressure of step (a);

(j) supplying said pressurized liquid oxygen to said evaporation step; and (k) withdrawing said crude argon and said evaporated oxygen.

In conjunction with the above, or alternatively independently, the invention also comprises: 11. A process for fractional distillation of a supply of cleaned, compressed, and cooled air to oxygen product of at least 98% purity plus optional coproduct crude argon comprising:

(a) rectifying a vapor derived from said supply air and which has an $O_2$ content no higher than that of said supply air to overhead $N_2$ product and bottom product kettle liquid in a high (HP) rectifier;

(b) removing nitrogen from said kettle liquid by feeding it in fluid phase to and distilling it in a nitrogen removal column;

(c) reboiling said $N_2$ removal column bottoms by exchanging latent heat with part of said supply air which is at least partially condensed thereby;

(d) withdrawing a sidestream liquid oxygen-argon mixture substantially free of nitrogen from an intermediate height of said $N_2$ removal column below the feed height;

(e) distilling said liquid sidestream in an argon distillation column to crude argon overhead product and liquid oxygen bottom product;

(f) exchanging latent heat between HP rectifier overhead $N_2$ and argon column bottoms so as to provide at least bottom reboil to the argon column and essentially all of the $LN_2$ overhead reflux for both the HP rectifier and the $N_2$ removal column; and (g) evaporating the liquid oxygen bottom product from both the argon column and the $N_2$ removal column and withdrawing it as product.

Still additional inventive features are described in dependent claims and the figures, as further elaborated below.

BRIEF DESCRIPTION OF THE DRAWINGS

The three figures are simplified schematic flowsheets of low-energy triple-pressure air distillation processes for production of high purity oxygen.

BEST MODE FOR CARRYING OUT THE INVENTION

Figure 1:
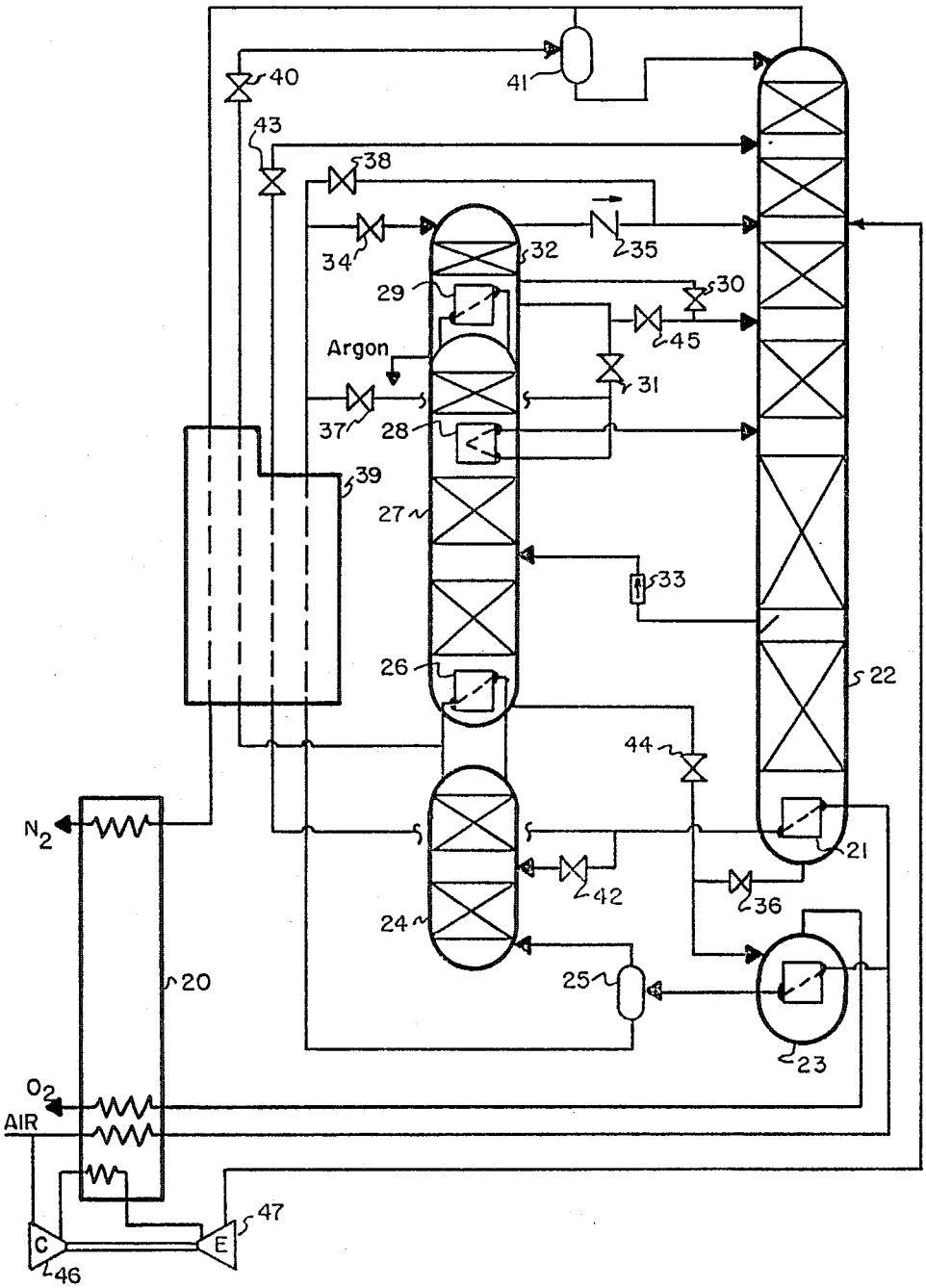
FIG. 1 incorporates all three features: total condensation reboil with liquid air split; full $LN_2$ reflux duty at a single heat exchanger; and intermediate reflux of argon column. Those features, in conjunction with companded air refrigeration, make possible the partial condensation LOXBOIL evaporator (high $pO_2$.) Also illustrated is a novel means for providing a liquid derived from kettle liquid, but having a desired level of $O_2$ content different from kettle liquid, to each reflux condenser for the argon column. The latter involves a zone of countercurrent vapor liquid contact for the kettle liquid, and also sequential (vice parallel) feeding the two condensers.

Referring to FIG. 1, compressed and cleaned supply air is cooled in main heat exchanger 20 to near its dew-point, a minor fraction (less than 25%) is routed to reboiler 21 of $N_2$ removal column 22 where it totally condenses, and the major fraction is routed to PC LOXBOIL evaporator 23 where it partially condenses while boiling product oxygen. The uncondensed portion of the air is fed to HP rectifier 25 (after optional phase separation by phase separator 25) and is rectified to overhead $N_2$ and liquid oxygen-enriched air bottom product commonly referred to as "kettle liquid". The overhead vapor $N_2$ is supplied to only a single latent heat exchanger-reboiler 26 of the argon distillation column 27. The liquid $N_2$ obtained from 26 is split between overhead refluxing column 24 and column 22, the latter via sensible heat exchanger 39, pressure letdown valve 40, and optional phase separator 41. The kettle liquid, which as illustrated may be combined with the partial condensation liquid from 23 or alternatively may be kept separate (there is a slight composition difference), is eventually fed in fluid phase to column 22, but first is at least partially evaporated so as to provide reflux to argon column 27.

It is important that the intermediate reflux condenser 28 and the overhead reflux condenser 29 of argon column 27 each supply a vapor stream with as high as $O_2$ content as possible to respective heights of $N_2$ removal column 22. The higher the $O_2$ content of the vapor from 28, the lower a height on column 22 that it can be introduced, thus reducing the column 22 minimum reboil requirement below that height, and corresponding by increasing the amount of reboil allowable in column 27 below condenser 28. This reboil increase results in increased argon recovery. A similar consideration applies to condenser 29.

Allowing for a typical condenser LMTD of about 1.5K, and an argon column overhead pressure of about 0.97 ATA, the vapor from condenser 29 through valve 30 to column 22 should have at least about 35% $O_2$ content. This could readily be done by total evaporation of part of the kettle liquid. However, then no liquid of even higher $O_2$ content would be available for supply to condenser 28 via valve 31. In order to make such a liquid derived from kettle liquid available, a zone of countercurrent vapor-liquid contact 32 is provided. Depressurized kettle liquid is supplied above zone 32 via pressure letdown valve 34. The amount of vapor generated by condenser 29 which enters contactor 32 is determined by control valve 30. Vapor exiting the top of contactor 32 is fed to column 22 via one-way valve 35. Optional valves 45 and 37 allow fine tuning of the quantity and composition of the liquid supplied to condenser 28. Similarly, bypass valve 38 allows control of the amount of kettle liquid supplied to condenser 29 via contactor 32, and is particularly useful in maintaining the desired margin against argon freezeup.

The overall result is that the kettle liquid is fed to column 22 in three different streams at differing heights, each of which may be liquid phase, vapor phase, or a combination, hence the term "fluid phase".

It will be understood that the liquid being evaporated in either or both of condensers 27 and 28 could be column 22 intermediate height liquid from the respective appropriate heights, in lieu of kettle liquid. This would not have any material effect on the thermodynamics or energy efficiency of the flowsheet, but would place some restrictions on the relative height placement of the columns, or require liquid pumping.

The condensed liquid air from 21 is split into two intermediate reflux streams by coordinated action of valves 42 and 43, for the HP rectifier 24 and column 22 respectively. Each stream should be less than about 15% of the total air supply, as otherwise much of the benefit of the split is lost.

A liquid oxygen-argon sidestream containing about 95% oxygen and no more than about 0.1% $N_2$ is withdrawn from column 22 and fed to column 27 via means for transport 33, which may be a pump, a one-way valve, or simply a barometric leg (depending on relative column heights). The liquid oxygen bottom product from both columns 27 and 22 is transported to LOXBOIL evaporator 23 via means for transport 44 and 36. Since 23 is at a higher pressure than either 27 or 22, it is preferably located at a lower elevation such that the barometric leg develops the necessary pressure increase, in which case 36 and 44 are simply valves. Similarly crude argon may be withdrawn as either vapor or liquid, and a barometric leg may be used to evaporate it at increased pressure also.

The process refrigeration technique depicted in FIG. 1 is the conventional expansion of a minor fraction of the supply air to $N_2$ removal column pressure in 47, but with the addition of a warm-end compression of the air to be expanded in compressor 46, which is powered by the expander. This companding reduces the flow requirement to the expander to approximately three-fourths of what otherwise is required, i.e., typically to below 10% of the total supply air. Of course an even greater flow reduction is possible with an additional externally powered compressor. Any reduction is desirable since it increases available air for the HP rectifier, which in turn produces more $LN_2$ and hence improves $O_2$ recovery. Instead of conventional or companded air refrigeration it is possible to substitute conventional or companded $N_2$ refrigeration, as described in a copending application. Still additional refrigeration options are possible, with two examples illustrated in FIGS. 2 and 3. Also, the compander compression power may be applied to other beneficial purposes, also with example illustrations in FIGS. 2 and 3.

Figure 2:
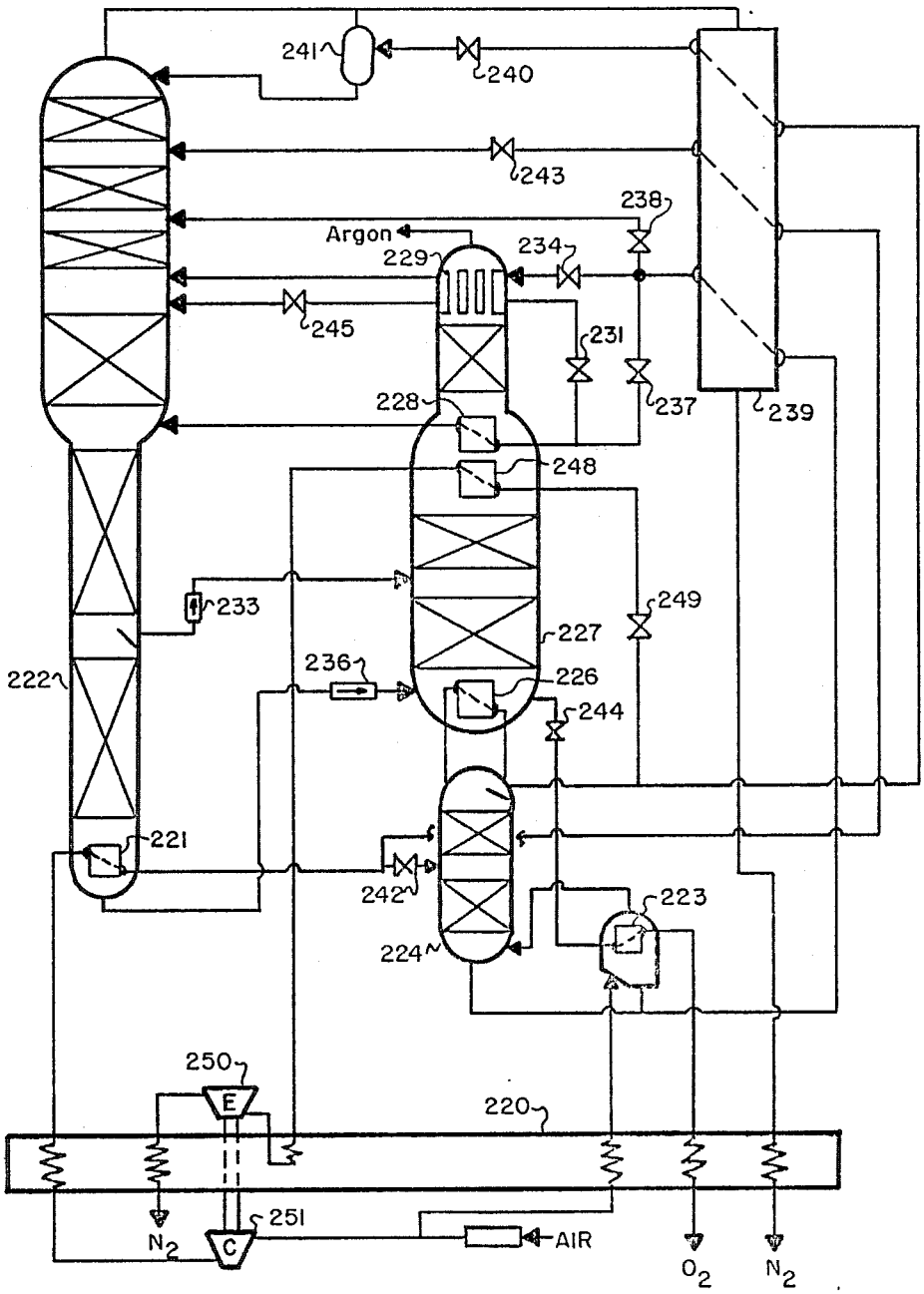
FIG. 2 is illustrative of the situation wherein high argon recovery is not as valuable as further energy reduction. An alternative refrigeration technique is illustrated which decreases argon recovery but increases oxygen recovery, even when the total condensation reboil air is companded to further lower the energy requirement.

Referring to FIG. 2, the same basic 3-column (triple pressure) configuration is depicted except that a different vapor is expanded (intermediate pressure $N_2$); a different stream is warm-compressed (the total condensation reboil stream); and a somewhat different argon column reflux arrangement is depicted. The three key features are still present; total condensation reboil of the $N_2$ removal column with liquid air split to two intermediate refluxes; at least two vertically spaced refluxes of the argon column, each with an associated vapor stream of differeing composition for different heights of the $N_2$ removal column; and all of the $LN_2$ reflux duty accomplished in a single heat exchanger. That combination of features supports the efficient PC LOXBOIL evaporator. Components 220 through 245 have similar descriptions as the correspondingly numbered FIG. 1 components, except components corresponding to 25, 30, 32 and 35 are not needed and hence not shown. The contactor is not necessary with this flowsheet because due to the companding, the columns 227 and 224 operate at about 1.5 to 2K colder than columns 27 and 24, and hence condenser 229 is capable of generating the high $O_2$ content liquid for valve 231 and condenser 228 without an extra contactor. Of course it is not precluded, and may be desirable in some circumstances.

The key differences from FIG. 1 are the "LINBOIL" condenser 248, which is supplied partially depressurized $LN_2$ via valve 249, thereby refluxing an intermediate height of argon column 227 and producing a vapor stream for expansion which neither bypasses the HP rectifier 224 nor the argon stripping section of column 227. The $N_2$ vapor is partially warmed in 220 and then work-expanded in expander 250. Since the pressure ratio of expansion is lower, more flow is necessary, on the order of 15% of the air supply. The crude argon recovery is decreased, since 248 substantially reduces the reboil available to the top section of 227. However, the increase in $LN_2$ means that compressor 251 can be applied to the air supply to 221, thus decreasing the supply pressure, while retaining full $O_2$ recovery.

Figure 3:
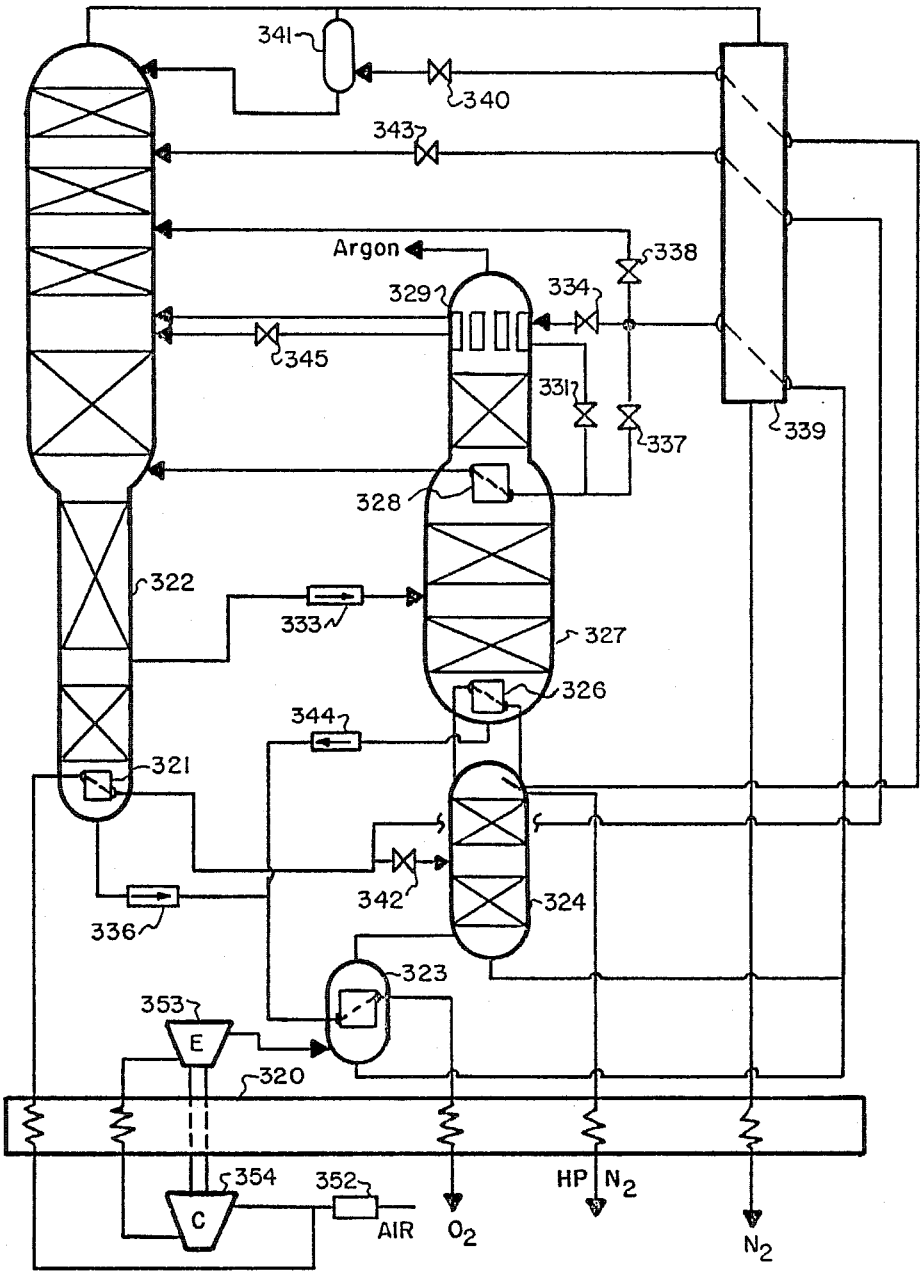
FIG. 3 illustrates yet a third environment, wherein there is less concern over energy reduction (e.g., low energy prices) and more concern for maximizing recoveries. With refrigeration via partial expansion of rectifier air, maximum $LN_2$ is available for increased oxygen recovery.

Referring to FIG. 3, another advantageous combination of the disclosed features is illustrated. Components 320 through 345 have similar descriptions to the corresponding 200-series components of FIG. 2. Component 352 generically indicates the compression and cleanup functions on the supply air. In FIG. 3, the vapor stream being expanded in expander 353 is the major fraction enroute to evaporator 323 and subsequently to rectifier 324. Since at least 75% of the air is expanded it only requires a very small pressure ratio of expansion. Compressor 354 is conveniently used to provide about one-fourth of the compression consumed at 353. The net result is that the supply air from 352 must be about 0.7 ATA higher in pressure than for example the FIG. 2 supply air. Because of this increased supply pressure (about 5 to 5.5 ATA), there is no need to additionally compress the supply to 321, and hence the 354 compression can be applied to the expander supply stream. This figure achieves the very high $O_2$ recoveries characteristic of FIG. 2, but without the decrease in crude argon recovery, at the expense of more energy input.

Although particular combinations and embodiments of the disclosed advantageous features have been illustrated which are presently believed to be most advantageous, many others will be apparent to the artisan. The traditional second HP rectifier overhead condenser could be added to any of the flowsheets. Partial condensation reboil can be substituted for total condensation. Some liquid may be withdrawn. Various column and heat exchanger physical configurations are known and possible. Low pressure drop column packing is preferred but not required. The expansion duty can be divided between two or more expanders, including the variation of expanding completely separate vapor streams. The scope of the intended invention is to be limited only by the claims.

I claim:

1. A process for fractional distillation of a supply of cleaned and compressed air to oxygen product of at least 98% purity plus optional coproduct crude argon comprising:

(a) evaporating product oxygen by exchanging latent heat with a major fraction of said supply air, which is partially condensed thereby;

(b) rectifying the condensed remainder of said major fraction to overhead $N_2$ and kettle liquid bottoms in a high pressure (HP) rectifier;

(c) totally condensing a minor fraction of the supply air in a reboiler for a nitrogen ($N_2$) removal column, thereby providing bottoms reboil to said column (d) splitting the liquid air into two streams and feeding one each to said HP rectifier and said $N_2$ removal column as respective intermediate refluxes therefor;

(e) feeding at least one fluid from the kettle liquid to said $N_2$ removal column;

(f) withdrawing a sidestream liquid oxygen-argon mixture substantially free of nitrogen from an intermediate height of said $N_2$ removal column below the feed height;

(g) distilling said liquid sidestream in an argon distillation column to crude argon overhead product and liquid oxygen bottom product;

(h) withdrawing liquid oxygen bottom product from both the $N_2$ removal column and the argon distillation column;

(i) increasing the liquid oxygen pressure to the evaporation pressure of step (a);

(j) supplying said pressurized liquid oxygen to said evaporation step; and (k) withdrawing said crude argon and said evaporated oxygen.

2. Process according to claim 1 further comprising reboiling the argon column bottoms and providing all $LN_2$ reflux for both the HP rectifier and the $N_2$ removal column by exchanging latent heat from HP rectifier overhead $N_2$ to argon column bottom liquid.

3. Process according to claim 2 further comprising:

(a) providing intermediate reflux to said argon column above the feed height and providing increased reboil rate to the $N_2$ removal column above the sidestream withdrawal height by exchanging latent heat between argon column intermediate height vapor and a liquid derived from at least one of:

(i) oxygen-enriched liquid from step 1.(a);

(ii) kettle liquid; and (iii) $N_2$ removal column intermediate height liquid; and (b) supplying the vapor resulting from said exchange of latent heat to said $N_2$ removal column intermediate height.

4. Process according to claim 3 further comprising limiting said minor fraction of air to no more than 25% of the total air supply, and limiting each of said liquid air streams to no more than 15% of the total air supply.

5. Process according to claim 3 further comprising:

(a) additionally compressing while warm a second minor stream of said supply air comprising no more than about 10% of the total supply air;

(b) partially cooling said additionally compressed stream;

(c) work expanding said additionally compressed stream and feeding it to said $N_2$ removal column; and (d) powering at least part of said compression step by said expansion step.

6. Process according to claim 3 further comprising:

(a) providing at least one of kettle liquid and partial condensation liquid for indirect latent heat exchange overhead refluxing of said argon column; and (b) supplying unevaporated liquid from step 7.(a) having an $O_2$ content higher than either kettle liquid or partial condensation liquid as said "liquid derived from" of step 3.

7. Process according to claim 1 further additionally compressing while warm said totally condensing minor air fraction of step 1.(c); and powering at least part of said additional compression by work-expanding a cold process vapor stream so as to provide needed refrigeration.

8. Process according to claim 7 further comprising selecting said HP rectifier air supply stream for at least part of said work-expansion.

9. Process according to claim 7 further comprising evaporating liquid $N_2$ at an intermediate pressure by exchanging latent heat with argon column intermediate height vapor and using said intermediate pressure $N_2$ as said work-expansion vapor.

10. A process for fractional distillation of a supply of cleaned, compressed, and cooled air to oxygen product of at least 98% purity plus optional coproduct crude argon comprising:

(a) rectifying a vapor derived from said supply air and which has an $O_2$ content no higher than that of said supply air to overhead $N_2$ product and bottom product kettle liquid in a high pressure (HP) rectifier;

(b) removing nitrogen from said kettle liquid by feeding it in fluid phase to and distilling it in a nitrogen removal column;

(c) reboiling said $N_2$ removal column bottoms by exchanging latent heat with part of said supply air which is at least partially condensed thereby;

(d) withdrawing a sidestream liquid oxygen-argon mixture substantially free of nitrogen from an intermediate height of said $N_2$ removal column below the feed height;

(e) distilling said liquid sidestream in an argon distillation column to crude argon overhead product and liquid oxygen bottom product;

(f) exchanging latent heat between HP rectifier overhead $N_2$ and argon column bottoms so as to provide at least bottom reboil to the argon column and essentially all of the $LN_2$ overhead reflux for both the HP rectifier and the $N_2$ removal column; and (g) evaporating the liquid oxygen bottom product from both the argon column and the $N_2$ removal column and withdrawing it as product.

11. Process according to claim 10 further comprising:

(a) exchanging latent heat between argon column intermediate height vapor and partially depressurized liquid $N_2$ from said argon column bottoms reboiler;

(b) partially warming the resulting intermediate pressure $N_2$ vapor and then work-expanding it to provide process refrigeration; and (c) using the work from step (b) to additionally compress the minor supply air fraction to be used for evaporating product oxygen.

12. Process according to claim 10 further comprising:

(a) reboiling the $N_2$ removal column bottoms by exchanging latent heat with a major fraction of supply air, which is partially condensed thereby, prior to feeding it to said HP rectifier;

(b) evaporating liquid oxygen to product oxygen by exchanging latent heat with a totally condensing minor fraction of the supply air; and (c) splitting the liquid air from part (b) into two intermediate reflux streams.

13. Process according to claim 10 further comprising totally condensing a minor fraction of said supply air to liquid air in conjunction with said 1.(c) reboiling step.

14. Process according to claim 13 further comprising dividing said liquid air into at least two streams of not more than 15% of the total air supply each, and feeding one each to the HP rectifier and the $N_2$ removal column as respective intermediate refluxes therefor.

15. Process according to claim 14 further comprising evaporating the combined liquid oxygen bottom products from the respective argon and $N_2$ removal columns at a pressure higher than that of either column by exchanging latent heat between a major fraction of said supply air and said pressurized liquid oxygen; and wherein said "vapor derived from said supply air" is the remaining oxygen-depleted vapor portion from said evaporating step.

16. Process according to claim 15 further comprising:

(a) refluxing the argon column from at least two vertically spaced heights;

(b) feeding vapors of differing $O_2$ contents generated in each reflux condenser of part (a) to different intermediate heights of the $N_2$ removal column;

(c) work-expanding a second minor fraction of the supply air to supply process refrigeration;

(d) additionally compressing said air to be expanded; and (e) providing at least part of the power necessary for said additional compression by said work expansion.

17. A fractional distillation apparatus for production of high purity oxygen from a supply of compressed, cleaned, and cooled air comprising:

(a) a high pressure rectifier;

(b) an argon distillation column;

(c) a reflux condenser for the HP rectifier which exchanges latent heat between said rectifier overhead vapor and said argon column bottom liquid;

(d) a nitrogen removal column which is refluxed by part of the liquid nitrogen from said reflux condenser;

(e) an $N_2$ removal column reboiler in which a minor fraction of said supply air is totally condensed to liquid air;

(f) a conduit for transport of a liquid sidestream from the $N_2$ removal column below the feed height to the feed point of said argon column;

(g) a liquid oxygen (LOX) evaporator;

(h) conduits for supplying the liquid bottom products from said argon column and $N_2$ removal column to said evaporator;

(i) a conduit for supplying a major fraction of said supply air to said LOX evaporator;

(j) a conduit for transporting at least the unevaporated portion of the air exiting the LOX evaporator to said HP rectifier; and (k) a means for splitting said liquid air into two streams for supply to respective intermediate reflux heights of said $N_2$ removal column and said HP rectifier.

18. A fractional distillation apparatus for production of high purity oxygen from a supply of compressed, cleaned, and cooled air comprising:

(a) a high pressure rectifier;

(b) an argon distillation column including an overhead condenser;

(c) a reflux condenser for the HP rectifier which exchanges latent heat between said rectifier overhead vapor and said argon column bottom liquid;

(d) a nitrogen removal column which is refluxed by part of the liquid nitrogen from said reflux condenser;

(e) an $N_2$ removal column reboiler in which a minor fraction of said supply air is totally condensed to liquid air;

(f) a conduit for transport of a liquid sidestream from the $N_2$ removal column below the feed height to the feed point of said argon column; and (g) an intermediate reflux condenser in said argon column in which a vapor is generated which is added to the $N_2$ removal column reboil vapor at a height below at least one $N_2$ removal column feed height.

* * * * *